United States Patent [19]

Kamp et al.

[11] Patent Number: 5,014,922

[45] Date of Patent: May 14, 1991

[54] CONTROL MEANS FOR APPARATUS FOR CROSS-WINDING PACKAGES

[75] Inventors: Heinz Kamp, Wegberg; Peter Gerhards; Siegfried Bruns, both of Monchen-Gladbach, all of Fed. Rep. of Germany

[73] Assignee: W. Schlafhorst & Co., Fed. Rep. of Germany

[21] Appl. No.: 481,730

[22] Filed: Feb. 16, 1990

Related U.S. Application Data

[63] Continuation of Ser. No. 275,744, Nov. 23, 1988, abandoned.

[30] Foreign Application Priority Data

Nov. 27, 1987 [DE] Fed. Rep. of Germany ..... 3740263

[51] Int. Cl.[5] ..... B65H 54/02; B65H 54/28

[52] U.S. Cl. ..... 242/18 R; 242/43 R; 242/43 A

[58] Field of Search ..... 242/18 R, 18 DD, 43 R, 242/43 A, 36, 45, 158 B

[56] References Cited

U.S. PATENT DOCUMENTS 4,349,160 9/1982 Niederer ..... 242/18 R
4,371,122 2/1983 Schuller ..... 242/43 R
4,394,986 7/1983 Hasegawa et al. ..... 242/18 R
4,494,702 1/1985 Miyake et al. ..... 242/18 R
4,515,320 5/1985 Slavik et al. ..... 242/43 R X

FOREIGN PATENT DOCUMENTS 2855616 6/1980 Fed. Rep. of Germany .
659055 12/1986 Switzerland .

*Primary Examiner*—Stanley N. Gilreath
*Attorney, Agent, or Firm*—Shefte, Pinckney & Sawyer

[57] ABSTRACT

Control means in an apparatus for cross-winding packages of textile yarn or the like is provided and includes means operable during at least a portion of the high speed or accelerating rotation for increasing the relative frequency of traverse of the traversing yarn guide means with respect to the rotational winding speed of the package from a frequency at which the ratio of the rotational winding speed to the relative frequency of traverse is greater than the ratio of the selected rotational winding speed and the related selected frequency of traverse. The control means can gradually increase the relative frequency during the high speed or accelerating rotation so that at least before the end of the high speed or accelerating rotation, the ratio of the rotational winding speed to the relative frequency of traverse of the yarn guide means is approximately the same as the ratio of the selected rotational winding speed and the related selected frequency.

2 Claims, 3 Drawing Sheets

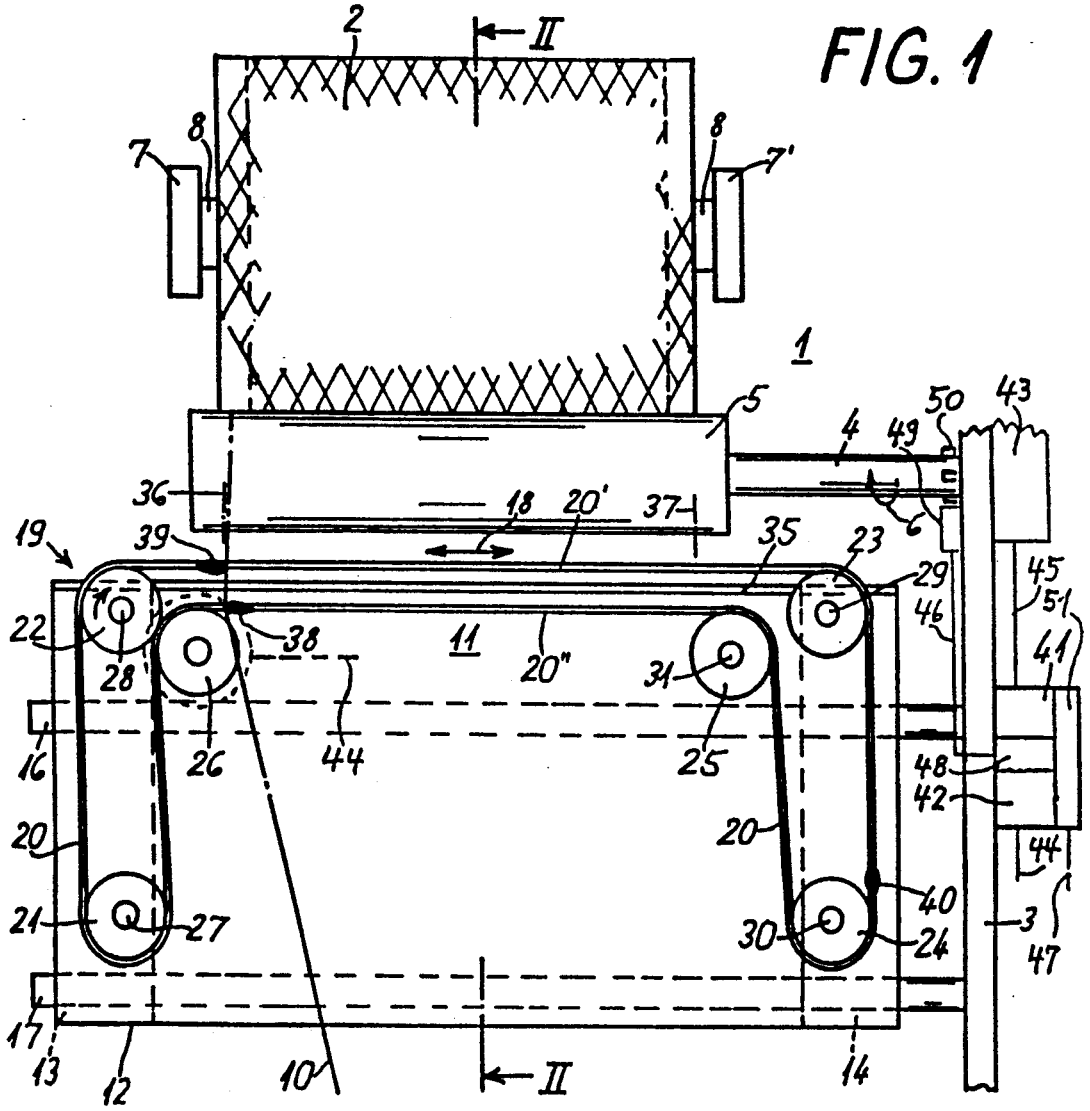
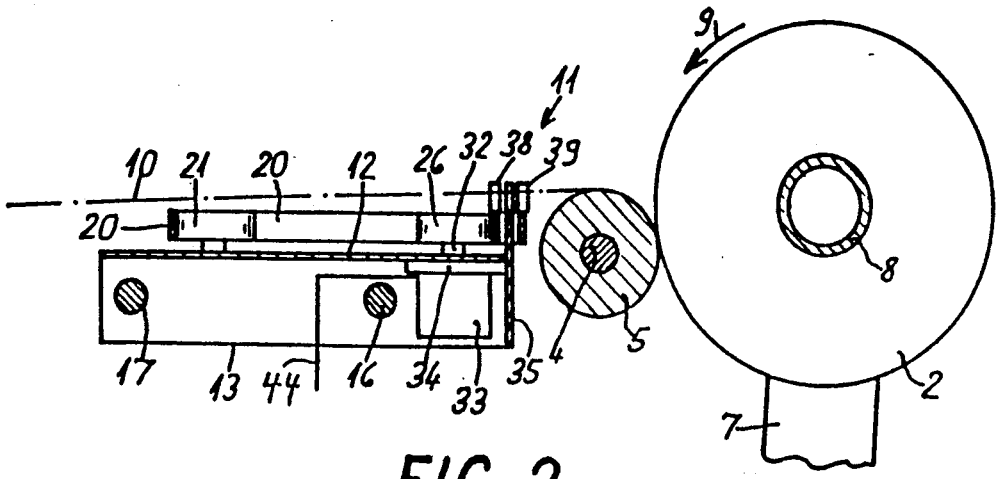
FIG. 2

CONTROL MEANS FOR APPARATUS FOR CROSS-WINDING PACKAGES

This is a continuation of co-pending application Ser. No. 275,744, filed Nov. 23,1988 now abandoned.

BACKGROUND OF THE INVENTION

The present invention relates to control means for apparatus for cross-winding a package of textile yarn, and more particularly to such control means that varies the ratio of the rotational speed of the package and the frequency of yarn guide traverse.

It is known to cross-wind yarn onto a package in which the package is rotated at differing rates of rotation during the winding process. For example, the package may be rotated at a higher than normal speed during a high speed winding period or the package may be wound at a speed different than the normal winding speed during the time the package is accelerated from a standstill to its normal speed. Commonly, the cross-winding of a package is controlled to feed the yarn at the same angle with respect to the package during the high speed period of rotation of the package as during the period of normal rotation of the package. However, imperfections in the package and undesirable production in the quality of the yarn in the package can occur during the high speed winding period and the acceleration period of the cross-wound package.

SUMMARY OF THE INVENTION

The present invention provides means for controlling the relationship between the rotation of the package and the frequency of the traversing yarn guide means so that the feeding of the yarn can proceed smoothly under proper tension and winding conditions as the package is wound at high speed or an accelerating rotational speed as it progresses into a normal operating speed.

Briefly described, the control means of the present invention is utilized in an apparatus for cross-winding packages of textile yarn or the like wherein means are provided for rotating the package at a selected rotational speed preceded by a higher speed or an accelerating rotational speed and wherein a traversing yarn guide means is provided for cross-winding yarn on the rotating package at a selected frequency of traverse with respect to the selected rate of rotation. The control means increases the relative frequency (f) of yarn guide traverse with respect to the rotational winding speed (n) from a frequency at which the ratio n:f is greater than the ratio n:f of the selected rotational speed and the related selected frequency.

Preferably, the control means gradually increases the relative frequency during high speed or accelerating rotation so that at least before the end of high speed or accelerating rotation the ratio n:f is approximately the same as the ratio n:f of the selected rotational speed and the related selected frequency.

In a modified embodiment the control means operates to gradually increase the relative frequency prior to termination of high speed or accelerating rotation to a frequency at which the ratio n:f is less than the ratio n:f of the selected rotational speed and the related selected frequency and subsequently decreases the relative frequency at least by the end of high speed or accelerating rotation to a frequency at which the ratio n:f is approximately the same as the ratio n:f of the selected rotational speed and the related selected frequency.

In the preferred embodiment, the control means control the yarn guide means to remain substantially without reciprocation during initial high speed or accelerating rotation prior to increasing the frequency.

The present invention is particularly applicable to apparatus for cross-winding packages using yarn guides reciprocated by a belt system carrying yarn engaging elements that traverse the yarn path.

BRIEF DESCRIPTION OF THE DRAWINGS

FIG. 1 is a front elevational view of one preferred embodiment of the control means of the present invention incorporated in an apparatus for cross-winding packages of textile yarn;

FIG. 2 is a vertical sectional view taken along line II—II of FIG. 1;

DETAILED DESCRIPTION OF THE PREFERRED EMBODIMENTS

Figure 3:
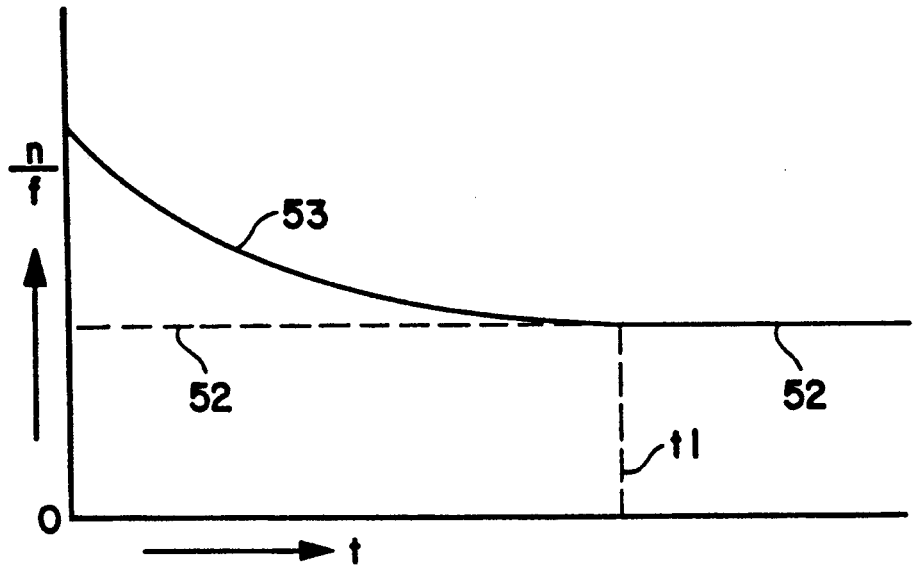
FIG. 3 is a graphical representation of one measurement of the winding operation, showing the ratio of the speed of rotation of the package to the frequency of reciprocation of the traversing yarn guide plotted on the ordinate and the time elapsed during the winding of the package plotted on the abscissa.

Referring to FIG. 1, an apparatus is shown for cross-winding yarn 10 onto a package 2 at a winding station of a winding machine 1. A supporting frame 3 rotatively supports a shaft 4 of a friction roller 5 for rotation in the direction indicated by the arrow 6. The friction roller 5 frictionally drives the package 2 which is formed on a sleeve 8 which is rotatively supported by a pair of swivelable, hanging support frames 7, 7', whereby the package 2 rotates in the direction indicated by the arrow 9 in FIG. 2.

The frame 3 also supports a traversing yarn guide means or system 11 which includes a support frame 12 of generally rectangular shape having a pair of flanges 13, 14 at each respective longitudinal end. The flanges 13, 14 are mounted on a pair of spaced, parallel guide bars 16,17 extending perpendicular from the flanges 13, 14 and fixedly secured to the frame 3. The yarn guide system traverses yarn 10 in the directions indicated by the double arrow 18 as the yarn, which is trained around the frictional roller 5 and onto the package 2, is continuously wound onto the package 2.

The yarn guide system 11 includes a belt assembly 19 having an endless belt 20 trained around guide rollers 21, 22, 23, 24 and 25 and around a drive roller 26. The guide rollers 21–25 are rotatively mounted on a plurality of shafts 27–31, respectively, projecting perpendicularly from the rectangular surface of the support frame 12. The drive roller 26 is fixedly mounted to a shaft 32 of an electric motor 33 having a flange 34 which is secured to the back rectangular surface of the support frame 12.

The endless belt 20 is driven by the drive roller 26 in a loop around the guide rollers 21–25 such that the belt moves from left to right along a path 20' (i.e., in the direction from the guide roller 22 toward the guide roller 23) and from right to left along a second travel path 20'' (i.e., in the direction from the guide roller 31 toward the drive roller 26).

The yarn guide system 11 also includes a yarn guide plate 35 secured to the support frame 12 and projecting beyond its front rectangular surface. The yarn guide plate 35 has a contoured top edge over which the yarn 10 passes as it moves toward the frictional roller 5. The endless belt 20 includes a plurality of yarn engaging elements 38,39 and 40 which are uniformly spaced along the belt for cooperating with the yarn guide plate 35 to traverse the yarn 10 in the direction indicated by the double arrow 18 along the extent defined by the two-lines 36, 37 in FIG. 1. The contoured edge of the yarn guide plate 35 has a concave profile with its lowermost portion in alignment with the longitudinal midpoint of the plate and extending upwardly therefrom in both directions toward the longitudinal ends of the plate such that when the yarn 10 is guided by one of the yarn engaging elements 38, 39 or 40 along the traversing path 20" to an engagement position generally in alignment with the dash line 36 the plate will cause the yarn to disengage from the yarn engaging element and be engaged by the next successive yarn engaging element 38, 39 or 40 traveling in the opposite direction along the traversing path 20' to an engagement position generally in alignment with the dash line 37 for engagement by the next successive engaging element 38, 39 or 40 traveling along the travel path 20". The yarn engaging elements 38, 39 and 40 are enlarged portions of the belt 20, each having a face projecting at a generally steep angle from the endless belt 20 for engaging the yarn 10. The faces of the yarn engaging elements 38, 39 and 40 are sheathed in metal sleeves for protection against abrasive wear.

The foregoing package winding apparatus and yarn traversing guide system are known in the art and do not form part of the present invention except in combination with the control means of the present invention. Further, the control means of the present invention is applicable to other types of yarn guide systems for traversing yarn during winding on a rotating package.

The shaft 4 of the friction roller 5 is driven by an electric motor 43 whcih is fixedly supported on the frame 3. The electric motor 43 for rotating the package and the electric motor 33 for operating the yarn guide system are frequency controlled motors. The motor 33 is connected by a connector 44 to a frequency converter 42 and the electric motor 43 is connected by a connector 45 to a frequency converter 41. The frequency converters 41, 42 are coupled to a common control unit 48 which is connected through a connector 46 with a sensor 49. The sensor 49 senses the passage thereby of four circumferentially uniformly spaced marks 50 on the shaft 4 and generated a signal to the control unit 48 in response to the passage thereby of one of the marks 50. The data relating to the passage of mark 50 by the sensor 49 is a measure of the rotational characteristics of the shaft 4, the friction roller 5 and, accordingly, the package 2.

A central unit 51 connects the frequency converts 41, 42 and the control unit 48 with one another and additionally provides power. The central unit 51 receives power through a conductor 47 from a power source (not shown).

At the beginning of the winding process, the central unit 51, by the frequency converter 41, controls the electric motor 43 to operate during a high speed running period and a period of constant speed relative to the frequency of the yarn guide system 11. The sensor 49 senses the rate of rotation of the shaft 4 and the control unit 48 controls, via the frequency converter 42, the electric motor 33, such that the desired n:f ratio as graphically represented in FIGS. 3 and 4 are achieved.

Figure 4:
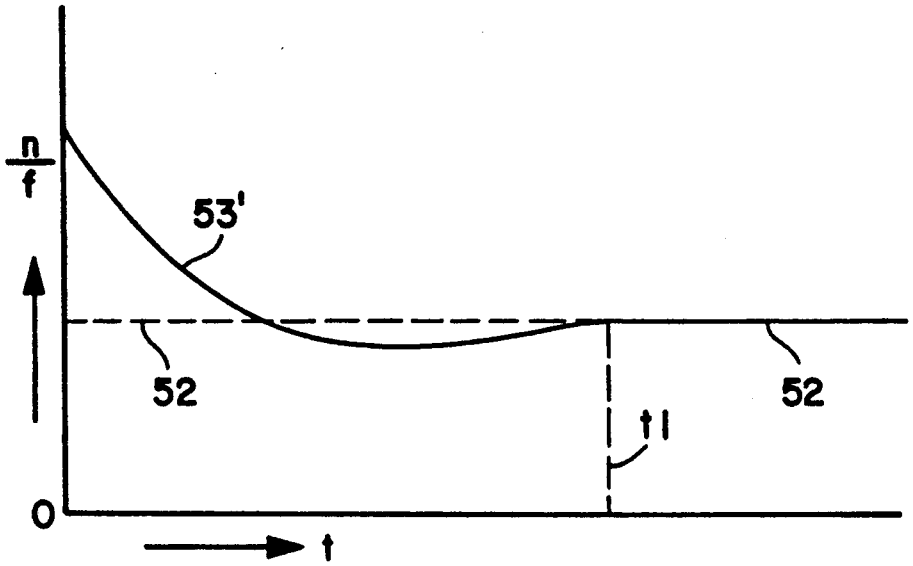
FIG. 4 is a graphical representation similar to FIG. 3 illustrating a modification of the relationship obtained by the control means of the present invention.

The control unit 48 controls the operation of the motor 33 to thereby operate the yarn guide system 11 in such a manner that the winding process characteristics graphically displayed in FIGS. 3 and 4 are achieved. In FIG. 3, the ratio of the rate of rotation n of the package 2 to the frequency f of the traversing yarn guide system 11 is plotted on the ordinate and the time elapsed during winding of the package 2 is plotted on the abscissa. The frequency f of the yarn guide system 11 is a measurement of the frequency of the system in moving the yarn 10 from one of the dash lines 36, 37 to the other of the dash lines and back to the original dash line, which comprises one cycle. In FIG. 3, the desired ratio of the rate or rotation of the package to the frequency of the yarn guide system 11 (the ratio of n:f) is shown as a curve 53 which extends from the time t=0 at the beginning of the high speed running period of the package 2 to a time t=t1 at the end of the high speed running period. A line 52 represents the desired n:f ratio subsequent to the end of the high speed running period of the package 2. Although the line 52 indicates that the n:f ratio remains constant following the end of the high speed running period, in actuality, during the winding of precision or constant pitch cross-wound packages and packages with constant angle or random cross-winding, the ratio n:f gradually decreases, however, this gradual decrease is not graphically represented in FIGS. 3 and 4 since, during the high speed running period t=0 to t1, only a single layer or a few layers can be wound onto the package 2 so that the ratio n:f in reality is more accurately graphically represented by the dash line 52 and the solid line 52.

The control unit 48 implements the desired n:f ratio which is graphically represented in FIG. 3 by controlling the operations of the traversing yarn guide system 11 and the motor 43 for driving the package 2. Specifically, the rate of rotation of the package 2 relative to the frequency of the yarn guide system 11 is controlled during the time t=0 to the time t=t1 (the high speed running period) at the ratio n:f represented by the curve 53. This means that frequency of the yarn guide system 11 gradually increases with respect to the rate of rotation of the package 2. After the time t1, a normal operating relation is obtained with a selected rotational speed and a related selected frequency as indicated by line 52.

If the rate of rotation n of the package 2 is kept constant relative to the frequency f of the yarn guide system 11 throughout the high speed running period and the period subsequent to that, the line of the ratio n:f would be as graphically represented by the dash line 52 and the solid line 52 in FIG. 3.

During the period prior to the beginning the high speed running period, that is, prior to the time t=0 in FIG. 3, the ratio n:f is increased above an initial operating ratio, which initial operating ratio corresponds to the typical operating ratio of the winding apparatus of the prior art. During the high speed running period during the time between t=0 to the time t=t1, the ratio n:f is decreased so that, at the end of the high speed running period, the ratio n:f represented by the line 52 is achieved. The lines 52 and 53 do not represent any specific numerical values of the ratio n:f in the illustrations of FIGS. 3 and 4.

The control unit 48 can also control the winding operation in conformance with the n:f ratio lines 53' and 52 of FIG. 4. As shown in FIG. 4, the rate of rotation n of the package 2 can be controlled relative to the frequency f of the yarn guide system 11 such that, during a period of winding during the high speed running period, the n:f ratio is less than the n:f ratio at which the operation proceeds following the end of the high speed running period, t1.

In one modification of the preferred embodiment of the present invention the control unit 48 may delay the beginning of the operation of the yarn guide system 11 until after the beginning of the high speed running period of the package 2, and subsequentially activate the yarn guide system 11 to obtain the ratio indicated by the lines 53 or 53', respectively.

The present invention is not limited to control during high speed rotation. It is applicable as well to start-up acceleration and other periods of speed variation during winding where enhanced quality can be obtained by advantageously controlled variation of the ratio n:f.

In certain circumstances, it may be preferable to directly sense the rate of rotation of the package 2 rather than sense the rate of rotation of the shaft 4.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for cross-winding packages of textile material or the like through the axial traversal of the textile material during rotation of the package, the frequency of traversal (f) varying in a predetermined manner with the contemporaneous rate of rotation (n) of the package, comprising:

rotating the package at a selected rotational speed during a normal operation period;

controlling the frequency of traverse (f) during the normal operation period in correspondence with the selected rotational speed to achieve a predetermined normal speed ratio (n:f) of the selected rotational speed to the frequency of traverse;

increasing the rotational speed of the package from a relatively lower rotational speed to the selected rotational speed during an acceleration period prior to the normal operation period; and controlling the frequency of traverse relative to the increasing rotational speed of the package during the acceleration period to achieve a predetermined higher speed ratio (n:f) during the acceleration period relative to the normal speed ratio (n:f) during the normal operation period.

2. In an apparatus for cross-winding packages of textile material or the like having means for rotating a package at a selected rotational speed during a normal operation period, the rotating means being operable to increase the rotational speed of the package from a relatively lower rotational speed to the selected rotational speed during an acceleration period prior to the normal operation period, and a traversing yarn guide means for cross-winding yarn on the rotating package at a frequency of traverse (f) selected in corresponding with the contemporaneous rate of rotation (n) of the rotating package, the ratio of the rate of rotation (n) to the frequency of traverse (f) being expressed as n:f, control means for controlling the frequency of traverse (f) with respect to the rate of rotation (n) to produce a relatively higher n:f ratio during the acceleration period than the n:f ratio during the normal operation period.

* * * * *